US009640315B2

(12) United States Patent
Gutiérrez Estrada

(10) Patent No.: US 9,640,315 B2
(45) Date of Patent: May 2, 2017

(54) LOW STRAY-LOSS TRANSFORMERS AND METHODS OF ASSEMBLING THE SAME

(71) Applicant: General Electric Company, Schenectady, NY (US)

(72) Inventor: Juan José Gutiérrez Estrada, Nogales (MX)

(73) Assignee: General Electric Company, Schenectady, NY (US)

( * ) Notice: Subject to any disclaimer, the term of this patent is extended or adjusted under 35 U.S.C. 154(b) by 49 days.

(21) Appl. No.: 13/893,046

(22) Filed: May 13, 2013

(65) Prior Publication Data

US 2014/0333408 A1 Nov. 13, 2014
US 2015/0310985 A9 Oct. 29, 2015

(51) Int. Cl.

| | |
|---|---|
| ***H01F 27/30*** | (2006.01) |
| ***H01F 27/28*** | (2006.01) |
| ***H01F 27/34*** | (2006.01) |
| ***H01F 41/02*** | (2006.01) |
| ***H01F 27/32*** | (2006.01) |

(52) U.S. Cl.
CPC ..... *H01F 27/346* (2013.01); *H01F 27/28* (2013.01); *H01F 27/2823* (2013.01); *H01F 27/323* (2013.01); *H01F 41/022* (2013.01); *H01F 2027/348* (2013.01)

(58) Field of Classification Search
CPC ..... H01F 2017/046; H01F 2027/328; H01F 27/2847; H01F 27/306; H01F 38/08
USPC ..... 336/180, 182, 183, 206, 207, 208; 29/602.1
See application file for complete search history.

(56) References Cited

U.S. PATENT DOCUMENTS 2,357,098 A * 8/1944 Garin ..... H01F 27/385 307/13
2,448,028 A * 8/1948 Gross ..... H01F 19/00 336/155

(Continued)

FOREIGN PATENT DOCUMENTS

CN 1444741 A 9/2003
CN 101165823 A 4/2008

(Continued)

OTHER PUBLICATIONS

Olivares et al.,"Reducing Losses in Distribution Transformers", Power Delivery, IEEE Transactions on, Jul. 2003, vol. 18 , Issue: 3, pp. 821-826.

(Continued)

*Primary Examiner* — Elvin G Enad
*Assistant Examiner* — Joselito Baisa
(74) *Attorney, Agent, or Firm* — General Electric Company

(57) ABSTRACT

A transformer includes a magnetic core, a first winding assembly, and a second winding assembly. The magnetic core includes a plurality of legs, including a first winding leg. The first winding assembly includes a first conductive conduit helically wound around the first winding leg a first number of turns. The first winding assembly has a first magnetic length. The second winding assembly includes a second conductive conduit wound around one of the plurality of legs a second number of turns. The second winding assembly is inductively coupled to the first winding assembly, and has a second magnetic length substantially equal to said first magnetic length.

7 Claims, 10 Drawing Sheets

(56) References Cited

U.S. PATENT DOCUMENTS 2,576,902 A * 11/1951 Duby ..... C25D 5/50 205/226
2,686,905 A * 8/1954 Schneider ..... H01F 27/343 336/182
2,947,961 A * 8/1960 Wahlgren ..... H01F 27/245 336/212
2,976,504 A * 3/1961 Christoffel et al. ..... 336/185
3,210,746 A * 10/1965 Clapp ..... G01D 5/20 336/136
3,244,960 A * 4/1966 Stevens ..... H02M 7/068 336/208
3,360,754 A * 12/1967 Gerdiman ..... 336/170
3,362,000 A * 1/1968 Sealey ..... H01F 37/005 336/155
3,505,320 A * 4/1970 Heinz ..... C07D 295/16 544/133
3,702,451 A * 11/1972 Hofing ..... 336/70
4,021,764 A * 5/1977 Winn ..... H01F 27/365 336/212
4,533,892 A 8/1985 Masuhara et al.
4,704,562 A * 11/1987 Postma ..... H01J 65/048 313/483
4,799,557 A * 1/1989 Jacquemet ..... E02D 7/06 173/117
5,719,544 A 2/1998 Vinciarelli et al.
5,752,671 A * 5/1998 Weber ..... B65H 75/10 242/578
5,817,398 A * 10/1998 Hollander ..... D06N 5/00 156/237
6,300,702 B1 10/2001 Jack et al.
6,324,851 B1 12/2001 Szasz et al.
6,653,924 B2 * 11/2003 Prager ..... H01F 27/346 336/212
6,663,039 B2 12/2003 Hoffmann et al.
6,712,297 B1 * 3/2004 Sugiyama ..... F02M 51/0682 239/533.2
6,724,280 B2 * 4/2004 Shamsaifar ..... H01P 1/207 333/209
6,804,876 B1 * 10/2004 Ito ..... H01F 17/045 29/602.1
7,180,216 B2 * 2/2007 Hirzel ..... H02K 21/24 310/168
7,271,696 B2 9/2007 Piaskowski
7,471,180 B2 * 12/2008 Seong ..... 336/200
7,752,735 B2 * 7/2010 Farmer et al. ..... 29/602.1
7,812,609 B2 * 10/2010 Martinez ..... G01V 3/28 324/339
7,886,424 B2 * 2/2011 Pauley et al. ..... 29/605
8,111,123 B2 * 2/2012 Lim et al. ..... 336/55
8,339,060 B2 * 12/2012 Siessegger ..... H05B 41/04 315/274
2004/0050978 A1 * 3/2004 Sugiyama ..... F02M 51/0682 239/585.2
2008/0012676 A1 * 1/2008 Suzuki ..... H01F 27/255 336/178
2008/0309445 A1 12/2008 Suzuki et al.
2011/0090039 A1 4/2011 Dziubek et al.
2011/0234355 A1 9/2011 Takeuchi et al.
2011/0248808 A1 10/2011 Singh et al.
2013/0082814 A1 4/2013 Markowski et al.

FOREIGN PATENT DOCUMENTS

CN 101789308 A 7/2010
CN 102842411 A 12/2012
CN 103021634 A 4/2013
EP 2400513 A1 12/2011
EP 2565883 A1 3/2013
WO 9804029 A1 1/1998
WO 9928929 6/1999
WO 2009056162 A1 5/2009
WO 2011024180 A1 3/2011

OTHER PUBLICATIONS

Department of Electrical Engineering Massachusetts Institute of Technology, "Magnetic Circuits and Transformers", Principles of Electrical Engineering Series, Ch. XIII, pp. 357-362, John Wiley & Sons, Inc., Nov. 1949.

Unofficial translation of Chinese Office Action and Search Report issued from corresponding CN Patent Application No. 201410199830.1 dated Jan. 18, 2017.

* cited by examiner

LOW STRAY-LOSS TRANSFORMERS AND METHODS OF ASSEMBLING THE SAME

BACKGROUND

The present application relates generally to transformers and, more particularly, to transformer assemblies designed to minimize stray losses.

Transformers are common electrical components used in electrical distribution, transmission, and control systems to transform an input voltage to a desired output voltage. The efficiency of conventional transformers is limited by energy losses associated with joule heating in the transformer windings, core losses (such as hysteresis and eddy current losses in the core), and stray losses. Stray losses result from magnetic flux leaking out of the transformer core and inducing eddy currents in conductive materials within the transformer assembly. These eddy currents are ultimately dissipated through resistive heat generation, which can often contribute to overheating and failure of transformers. Additionally, stray losses (and the resulting eddy currents) are amplified, often significantly, in transformers supplying voltage to a non-linear load, such as electronic equipment. Conventional transformers are not designed to minimize such stray losses.

BRIEF DESCRIPTION

In one aspect, a transformer is provided. The transformer includes a magnetic core, a first winding assembly, and a second winding assembly. The magnetic core includes a plurality of legs, including a first winding leg. The first winding assembly includes a first conductive conduit helically wound around the first winding leg a first number of turns. The first winding assembly has a first magnetic length. The second winding assembly includes a second conductive conduit wound around one of the plurality of legs a second number of turns. The second winding assembly is inductively coupled to the first winding assembly, and has a second magnetic length substantially equal to said first magnetic length.

In another aspect, a transformer is provided. The transformer includes a magnetic core, a first winding assembly, and a second winding assembly. The magnetic core includes a winding leg. The first winding assembly includes a plurality of first layers, and is inductively coupled to the magnetic core. The second winding assembly is inductively coupled to the first winding assembly. The second winding assembly includes a plurality of second layers. The first and second winding assemblies are concentrically wound around the winding leg in an interleaved configuration such that each second layer is disposed between at least two adjacent first layers.

In yet another aspect, a method of assembling a transformer is described. The method includes providing a magnetic core including a plurality of legs including a first winding leg, providing a first winding assembly including a first conductive conduit, providing a second winding assembly including a second conductive conduit, inductively coupling the first winding assembly to the magnetic core by helically winding the first conductive conduit around the first winding leg a first number of turns such that the first winding assembly has a first magnetic length, and inductively coupling the second winding assembly to the first winding assembly by winding the second conductive conduit around one leg of the plurality of legs a second number of turns such that the second winding assembly has a second magnetic length substantially equal to the first magnetic length.

In yet another aspect, a method of assembling a transformer is described. The method includes providing a magnetic core including a winding leg, providing a first winding assembly including a plurality of first layers, providing a second winding assembly including a plurality of second layers, and concentrically winding the first and second winding assemblies around the winding leg of the magnetic core in an interleaved configuration such that each second layer is disposed between at least two adjacent first layers.

Although specific features of various embodiments may be shown in some drawings and not in others, this is for convenience only. Any feature of any drawing may be referenced and/or claimed in combination with any feature of any other drawing.

DETAILED DESCRIPTION

Exemplary embodiments of low stray-loss transformers are described herein. In one embodiment, a transformer includes a magnetic core, a first winding assembly, and a second winding assembly. The magnetic core includes a plurality of legs, including a first winding leg. The first winding assembly has a first magnetic length, and includes a first conductive conduit helically wound around the first winding leg a first number of turns. The second winding assembly is inductively coupled to the first winding assembly, and includes a second conductive conduit wound around one of the plurality of legs a second number of turns. The second winding assembly has a second magnetic length substantially equal to the first magnetic length. In another embodiment, a transformer includes a magnetic core, a first winding assembly, and a second winding assembly. The magnetic core includes a winding leg. The first winding assembly includes a plurality of first layers, and is inductively coupled to the magnetic core. The second winding assembly is inductively coupled to the first winding assembly, and includes a plurality of second layers. The first and second winding assemblies are concentrically wound around the winding leg in an interleaved configuration. Each second layer is disposed between at least two adjacent first layers.

Figure 1:
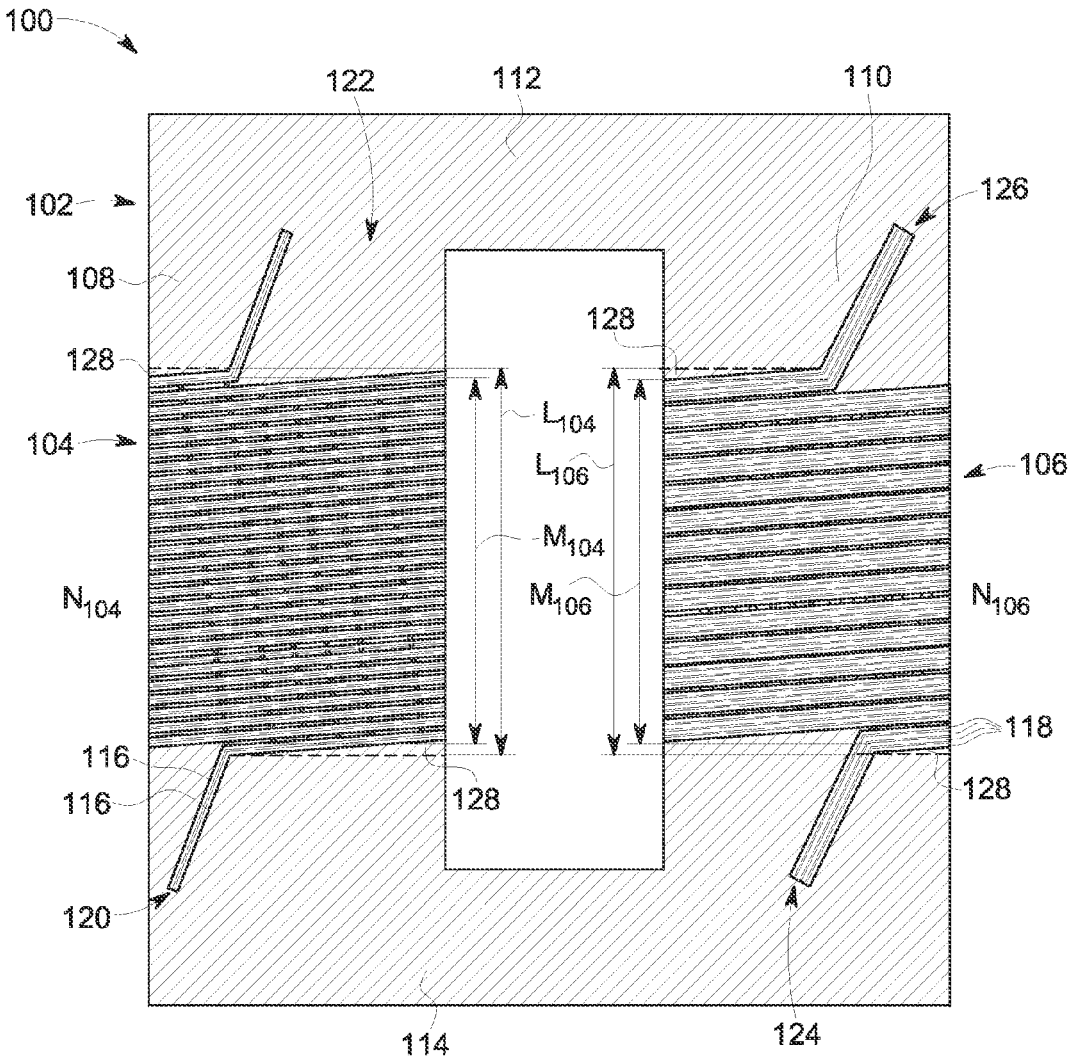
FIG. 1 is side view of a transformer including winding assemblies having substantially equal magnetic lengths.

FIG. 1 is a side view of a transformer 100 including a magnetic core 102, a first winding assembly 104, and a second winding assembly 106. Transformer 100 illustrated in FIG. 1 is a core-type transformer, although other transformers, such as a shell-type transformer, may be used without departing from the scope of the present disclosure.

Magnetic core 102 includes generally parallel first and second winding legs 108 and 110 coupled together by upper and lower portions 112 and 114 of magnetic core 102. Together, first and second winding legs 108 and 110, and upper and lower portions 112 and 114 form a closed loop for magnetic flux generated by first and/or second winding assemblies 104 and 106. In the embodiment illustrated in FIG. 1, magnetic core 102 is constructed from ferrite, although any other material having a suitable magnetic permeability that enables transformer 100 to function as described herein may be used for magnetic core 102. In the embodiment illustrated in FIG. 1, magnetic core 102 has a square cross-section. In alternative embodiments, magnetic core 102 may have a circular cross-section, a polygonal cross-section, or any other suitably shaped cross-section that enables transformer 100 to function as described herein.

First and second winding assemblies 104 and 106 are inductively coupled to one another by magnetic core 102. More specifically, first winding assembly 104 includes one or more conductive conduits 116 connected in parallel and helically wound around first leg 108, forming a number of turns $N_{104}$ around first leg 108. Similarly, second winding assembly 106 includes one or more conductive conduits 118 connected in parallel and helically wound around second leg 110, forming a number of turns $N_{106}$ around second leg 110. The ratio of $N_{104}$ to $N_{106}$ is the turns ratio of transformer 100, and can be adjusted to obtain a desired step up or step down between an input voltage and an output voltage.

In the embodiment illustrated in FIG. 1, first winding assembly 104 includes two conductive conduits 116 connected in parallel and helically wound around first leg 108. Each turn of first winding assembly 104 thus includes two conductive conduits 116. In alternative embodiments, first winding assembly 104 may include more or fewer conductive conduits 116, such as one, three, four, or five conductive conduits, or any other suitable number of conductive conduits that enables transformer 100 to function as described herein. In the embodiment illustrated in FIG. 1, second winding assembly 106 includes four conductive conduits 118 connected in parallel and helically wound around second leg 110. Each turn of second winding assembly 106 thus includes four conductive conduits 118. In alternative embodiments, second winding assembly 106 may include more or fewer conductive conduits 118, such as one, two, three, or five conductive conduits, or any other suitable number of conductive conduits that enables transformer 100 to function as described herein.

In the embodiment illustrated in FIG. 1, conductive conduits 116 and 118 are insulated copper wiring, although any other suitably conductive electrical conduit may be used for conductive conduits 116 and 118 that enables transformer 100 to function as described herein.

In operation, first and second terminal ends 120 and 122 of first winding assembly 104 are connected to the positive and negative terminals of a voltage source (not shown), and the first and second terminal ends 124 and 126 of second winding assembly 106 are connected to the input and output terminals of a load (not shown). Current flowing through first winding assembly 104 induces a current in second winding assembly 106, which is delivered to the load at a desired voltage. Alternatively, second winding assembly 106 may be connected to a voltage source, and first winding assembly 104 may be connected to a load.

Each winding assembly 104 and 106 has an axial length $L_{104}$ and $L_{106}$. As shown in FIG. 1, the axial length $L_{104}$ and $L_{106}$ of each winding assembly 104 and 106 is the axial distance (i.e., the distance along the respective leg of magnetic core 102) between opposing ends of the helically wound portion of the respective winding assembly. Each winding assembly 104 and 106 also has a magnetic length $M_{104}$ and $M_{106}$. The magnetic length of a winding assembly refers to an average axial length of the core leg around which the winding assembly is wound that is covered, or wound, by the winding assembly. Due to the helical winding of first and second winding assemblies 104 and 106, there are sections 128 near the top and bottom of each leg 108 and 110 of magnetic core 102 that are only partially wound by a winding assembly. Accordingly, magnetic lengths $M_{104}$ and $M_{106}$ of helically wound winding assemblies 104 and 106 are less than corresponding axial lengths $L_{104}$ and $L_{106}$.

Magnetic lengths $M_{104}$ and $M_{106}$ of winding assemblies 104 and 106 can be determined based upon axial lengths $L_{104}$ and $L_{106}$ of winding assemblies 104 and 106. In particular, magnetic length $M_{104}$ of first winding assembly 104 is equal to $$L_{104}\left(\frac{N_{104}-1}{N_{104}}\right), \qquad \text{Eq. 1}$$

where $L_{104}$ is the axial length of first winding assembly 104 and $N_{104}$ is the number of turns of first winding assembly 104. Similarly, magnetic length $M_{106}$ of second winding assembly 106 is equal to $$L_{106}\left(\frac{N_{106}-1}{N_{106}}\right), \qquad \text{Eq. 2}$$

where $L_{106}$ is the axial length of second winding assembly 106 and $N_{106}$ is the number of turns in second winding assembly 106.

Partially wound sections 128 of transformer 100 account for at least some of the stray losses limiting the efficiency of transformer 100. Stray losses related to partially wound sections 128 are amplified where the magnetic length of one winding assembly is different than the magnetic length of a second winding assembly.

Figure 2:
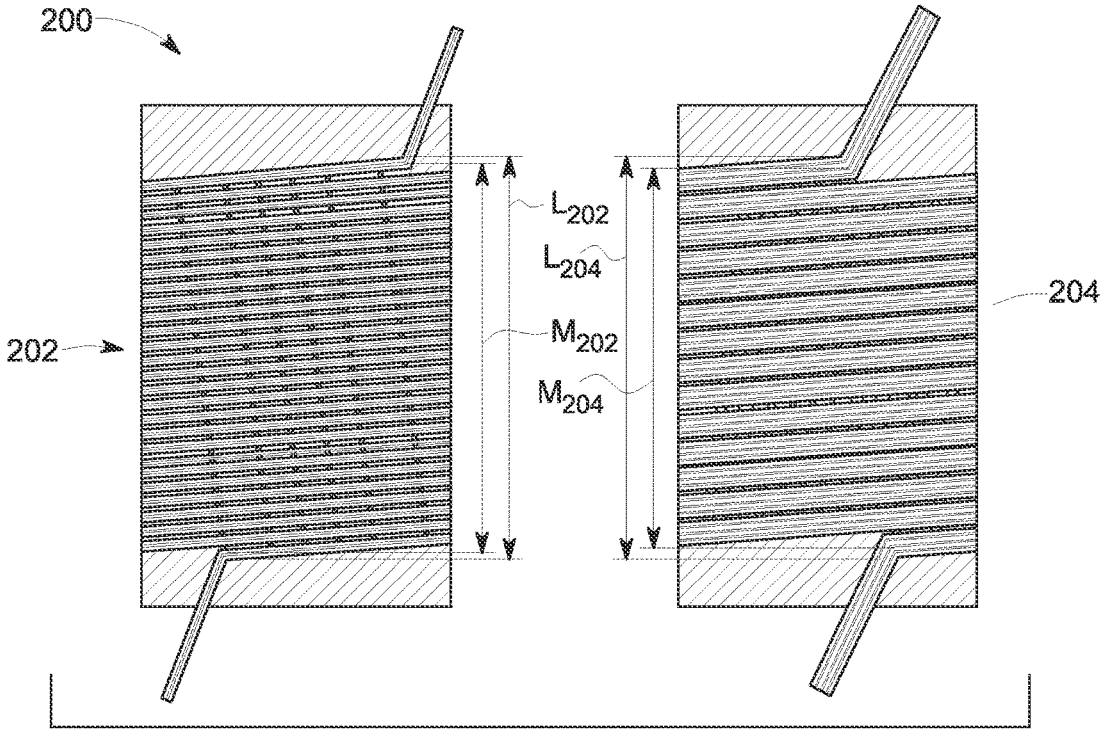
FIG. 2 is a partial side view of a conventional transformer.

FIG. 2 is a partial side view of a conventional transformer 200. Conventional transformer 200 is constructed such that the first and second windings 202 and 204 have the same axial dimensions $L_{202}$ and $L_{204}$. Because first and second windings 202 and 204 have different physical characteristics (e.g., number of turns, dimension of conductive conduit, number of conductive conduits per turn, etc.), the magnetic lengths $M_{202}$ and $M_{204}$ of each winding 202 and 204 are different. Thus, the construction of conventional transformer 200 amplifies stray losses associated with partially wound sections 128.

Referring back to FIG. 1, transformer 100 is assembled such that the first and second winding assemblies 104 and 106 have substantially equal magnetic lengths $M_{104}$ and $M_{106}$. In particular, axial length $L_{106}$ of second winding assembly 106 is based upon the magnetic length $M_{104}$ of first winding assembly 104, which in turn is based upon axial length $L_{104}$ of first winding assembly 104. Using the above relationships between the axial length of a given winding assembly and the magnetic length of a given winding assembly, axial length $L_{106}$ of second winding assembly 106 may be selected according to the following equation:

$$L_{104}\left(\frac{N_{106}}{N_{104}}\right)\left(\frac{N_{104}-1}{N_{106}-1}\right), \quad \text{Eq. 3}$$

where $L_{104}$ is the axial length of first winding assembly 104, $N_{106}$ is the number of turns in second winding assembly 106, and $N_{104}$ is the number of turns in first winding assembly 104. Alternatively, axial length $L_{104}$ of first winding assembly 104 may be based upon axial length $L_{106}$ of second winding assembly 106. As a result, magnetic lengths $M_{104}$ and $M_{106}$ of first and second winding assemblies 104 and 106 are substantially equal to one another. Therefore, the structure of transformer 100 improves efficiency over conventional transformers by reducing stray losses.

Although transformer 100 is illustrated as including two winding assemblies and two winding legs, transformer 100 is not limited to the specific embodiment illustrated in FIG. 1. For example, in alternative embodiments, transformer 100 may include more than two winding assemblies having substantially equal magnetic lengths. The winding assemblies may be wound around the same winding leg, or different winding legs. In yet further alternative embodiments, transformer 100 may include only one winding leg, or transformer 100 may include more than two winding legs.

Figure 3:
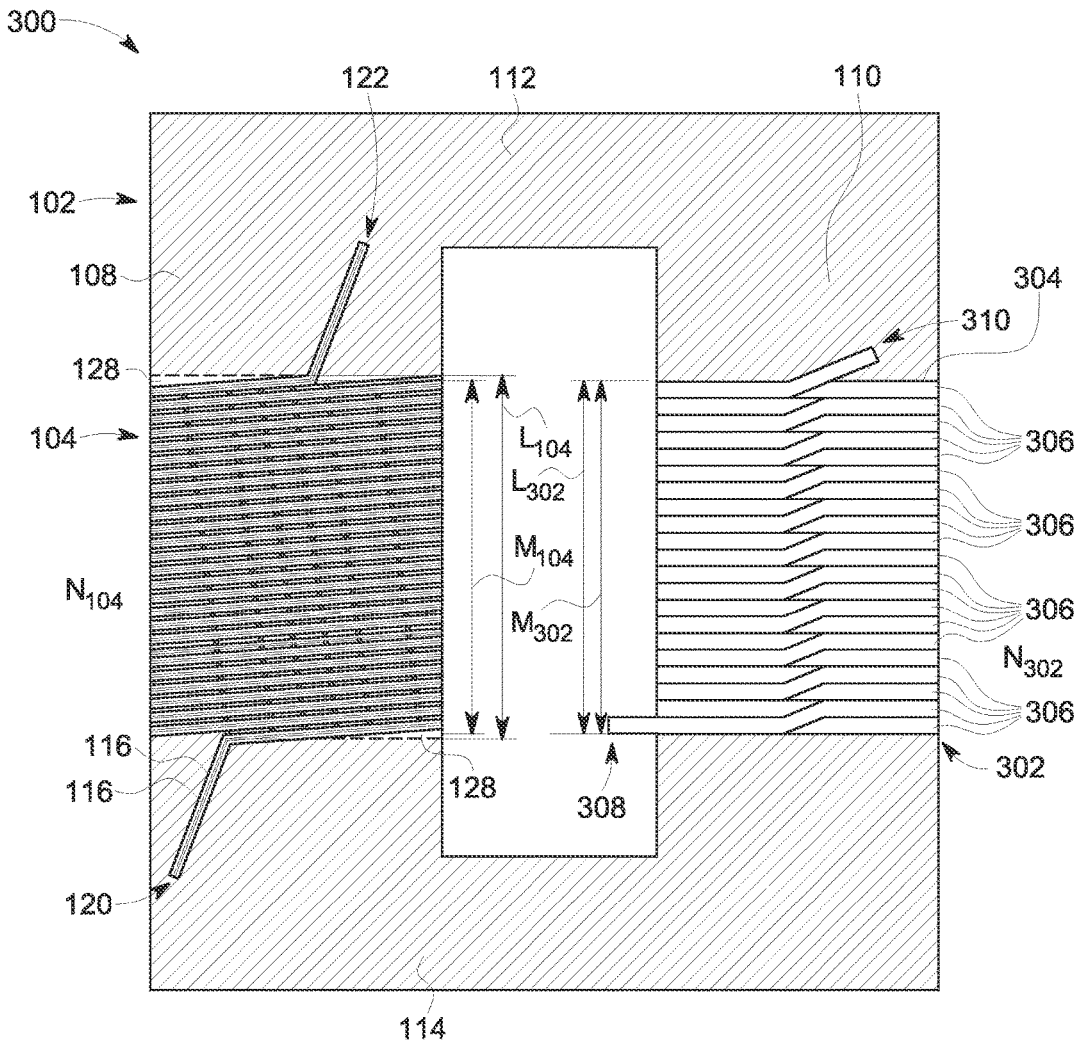
FIG. 3 is a side view of an alternative transformer including winding assemblies having substantially equal magnetic lengths.

FIG. 3 is a side view of an alternative transformer 300 designed to minimize stray losses. Transformer 300 is substantially similar to transformer 100 (shown in FIG. 1), except transformer 300 includes a disk-type winding assembly. As such, components shown in FIG. 3 are labeled with the same reference symbols used in FIG. 1.

Second winding assembly 302 of transformer 300 is a disk-type winding assembly. More specifically, second winding assembly 302 includes a conductive conduit 304 wound around second leg 110 to form a plurality of disks 306 serially disposed along the axial length of second leg 110. Each disk 306 is formed by one or more concentric layers of conductive conduit 304 extending in a radial direction relative to the longitudinal axis of second leg 110. Each layer corresponds to one turn of second winding assembly 302 around second leg 110. Second winding assembly 302 is wound around second leg 110 a total of $N_{302}$ turns. Disks 306 are connected in series, and are wound alternately from inside to outside and from outside to inside such that disks 306 are formed from a single conductive conduit.

In the embodiment illustrated in FIG. 3, conductive conduit 304 is an insulated copper band, although any outer suitably conductive electrical conduit may be used for conductive conduit that enables transformer 300 to function as described herein.

Similar to transformer 300, in operation, first and second terminal ends 120 and 122 of first winding assembly 104 are connected to the positive and negative terminals of a voltage source (not shown), and the first and second terminal ends 308 and 310 of second winding assembly 302 are connected to the input and output terminals of a load (not shown). Current flowing through first winding assembly 104 induces a current in second winding assembly 302, which is delivered to the load at a desired voltage. Alternatively, second winding assembly 302 may be connected to a voltage source, and first winding assembly 104 may be connected to a load.

Similar to first and second winding assemblies 104 and 106 of transformer 100, second winding assembly 302 has an axial length $L_{302}$ and a magnetic length $M_{302}$. Because second winding assembly 302 is a disk-type winding assembly, there are no partially wound sections 128 on second leg 110 of magnetic core 102. As a result, axial length $L_{302}$ and magnetic length $M_{302}$ are substantially equal.

Similar to transformer 100, transformer 300 is assembled such that the first and second winding assemblies 104 and 302 have substantially equal magnetic lengths $M_{104}$ and $M_{302}$. In particular, axial length $L_{302}$ of second winding assembly 302 is based upon the magnetic length $M_{104}$ of first winding assembly 104, which in turn is based upon axial length $L_{104}$ of first winding assembly 104. Using the above relationships between the axial length of a given winding assembly and the magnetic length of a given winding assembly, axial length $L_{302}$ of second winding assembly 302 may be selected according to the following equation:

$$L_{104}\left(\frac{N_{104}-1}{N_{104}}\right), \quad \text{Eq. 4}$$

where $L_{104}$ is the axial length of first winding assembly 104, and $N_{104}$ is the number of turns in first winding assembly 104. Alternatively, axial length $L_{104}$ of first winding assembly 104 may be based upon axial length $L_{302}$ of second winding assembly 302. In such embodiments, axial length $L_{104}$ of first winding assembly 104 may be selected according to the following equation:

$$L_{302}\left(\frac{N_{104}}{N_{104}-1}\right), \quad \text{Eq. 5}$$

where $L_{302}$ is the axial length of second winding assembly 302, and $N_{104}$ is the number of turns in first winding assembly 104. As a result, transformer 300 may be assembled such that magnetic lengths $M_{104}$ and $M_{302}$ of first and second winding assemblies 104 and 304 are substantially equal to one another. Therefore, the structure of transformer 300 improves efficiency over conventional transformers by reducing stray losses.

Although transformer 300 is illustrated as including two winding assemblies and two winding legs, transformer 300 is not limited to the specific embodiment illustrated in FIG. 300. For example, in alternative embodiments, transformer 300 may include more than two winding assemblies having substantially equal magnetic lengths. The winding assemblies may be wound around the same winding leg, or different winding legs. In yet further alternative embodiments, transformer 300 may include only one winding leg, or transformer 300 may include more than two winding legs.

Figure 4:
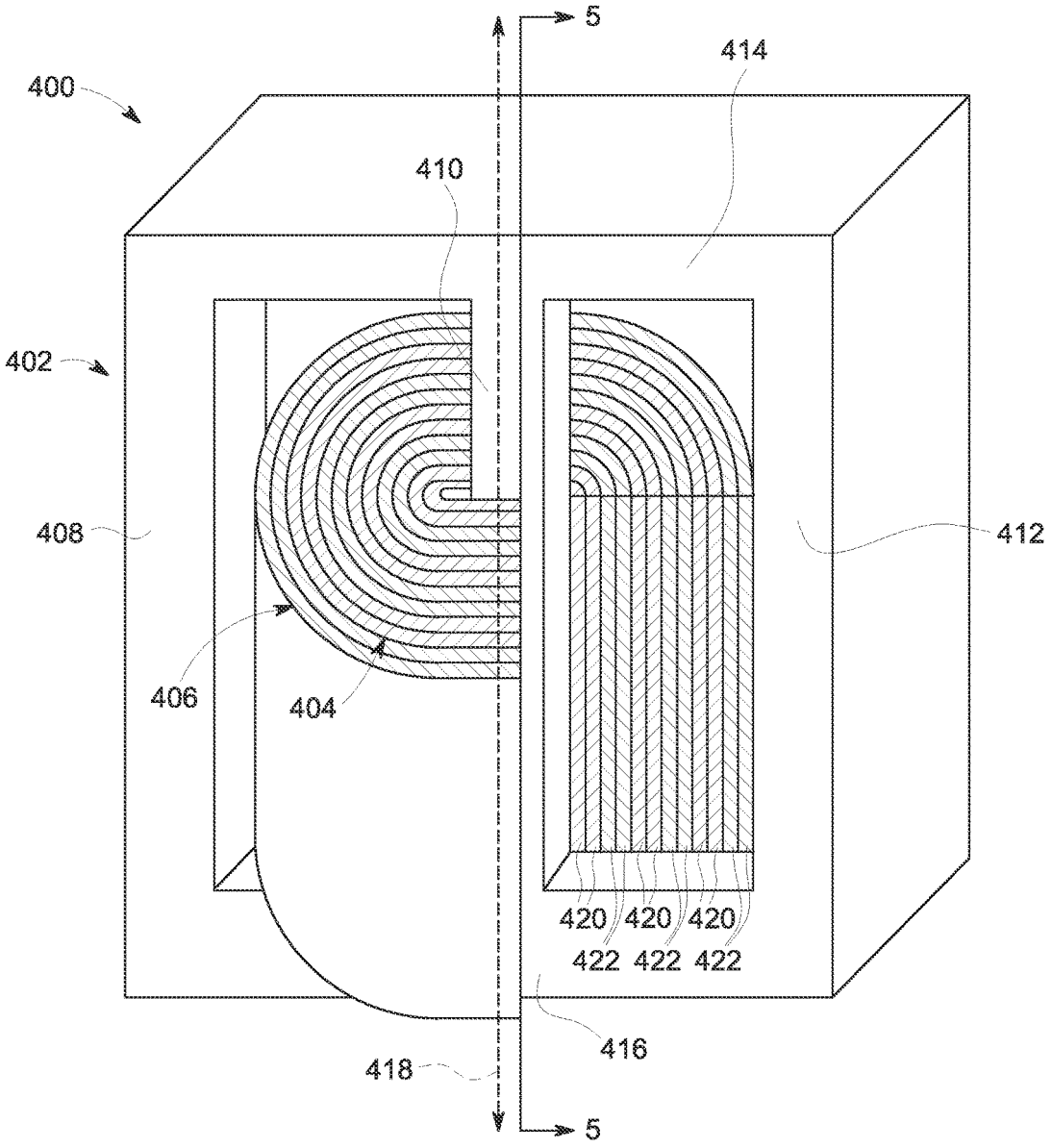
FIG. 4 is a perspective view of a transformer including interleaved concentrically wound winding assemblies.

Referring now to FIG. 4, an alternative transformer designed to minimize stray losses is indicated generally at 400. The transformer includes a magnetic core 402, a first winding assembly 404, and a second winding assembly 406. A portion of the first and second winding assemblies 404 and 406 has been removed for illustration. Magnetic core 402 includes at a first leg 408, a second leg 410, and a third leg 412 each coupled together by opposing upper and lower portions 414 and 416. In the embodiment shown in FIG. 4, second leg 410 of magnetic core 402 is used as the winding leg. In alternative embodiments, any leg of magnetic core 402 may be used as a winding leg. In yet further alternative embodiments, more than one leg of magnetic core 402 may be used as a winding leg.

In the embodiment illustrated in FIG. 4, magnetic core 402 is constructed from ferrite, although any other material having a suitable magnetic permeability that enables transformer 400 to function as described herein may be used for magnetic core 402. In the embodiment illustrated in FIG. 4, magnetic core 402 has a square cross-section. In alternative embodiments, magnetic core 402 may have a circular cross-section, a polygonal cross-section, or any other suitably shaped cross-section that enables transformer 400 to function as described herein.

First winding assembly 404 and second winding assembly 406 are concentrically wound around second leg 410 of magnetic core 402. First and second winding assemblies 404 and 406 are also coaxially aligned with a longitudinal axis 418 of second leg 410 of magnetic core 402. First and second winding assemblies 404 and 406 are thus inductively coupled to one another by magnetic core 402.

First winding assembly 404 includes a plurality of first layers 420 each formed by a single, continuous piece of conductive material. In the embodiment shown in FIGS. 4 and 5, a conductive conduit, referred to as first conductive conduit 502 (shown in FIG. 5), is used as the conductive material. First conductive conduit 502 is wound around second leg 410 of magnetic core 402 such that each first layer 420 of first winding assembly 404 has the same orientation, referred to as a first orientation. Thus, first winding assembly 404 is wound around second leg 410 in a first orientation.

Figure 5:
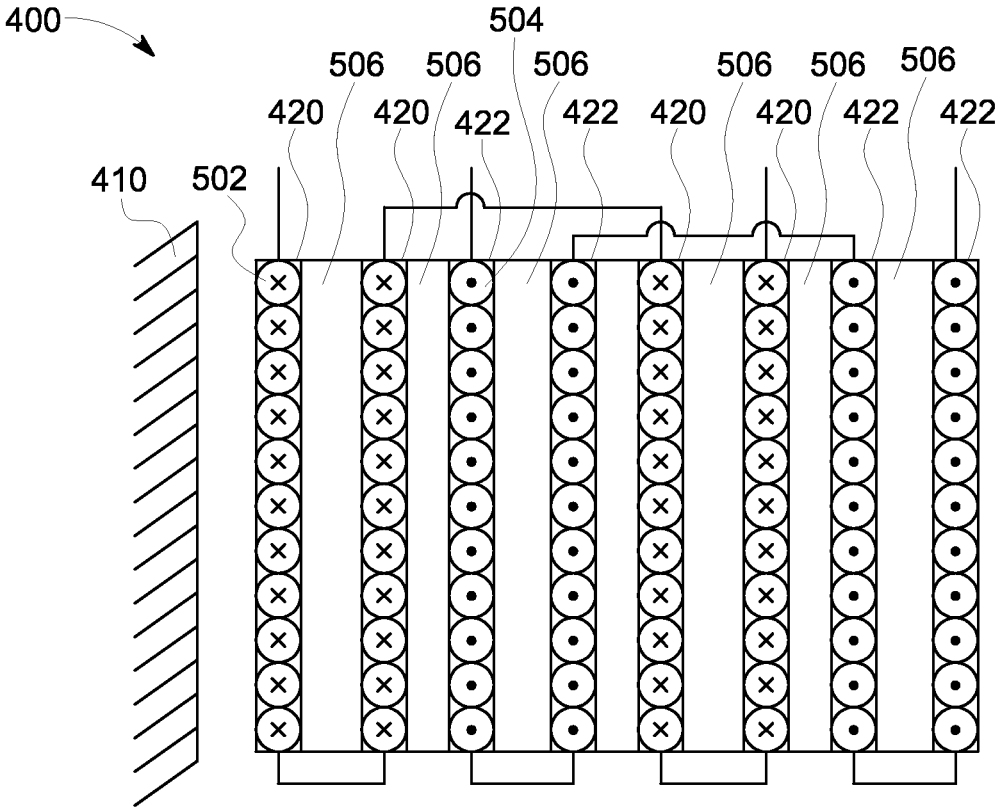
FIG. 5 is a schematic cross-sectional diagram of the transformer illustrated in FIG. 4.

In the embodiment illustrated in FIGS. 4 and 5, first conductive conduit 502 is helically wound around second leg 410 of magnetic core 402. In alternative embodiments, first conductive conduit 502 may be wound in any suitable layered or interleaved configuration that enables transformer 400 to function as described herein. For example, first conductive conduit 502 be wound as a disk-type winding, as described and shown in more detail above with reference to FIG. 3.

Second winding assembly 406 includes a plurality of second layers 422 each formed by a single, continuous piece of conductive material. In the embodiment shown in FIGS. 4 and 5, a conductive conduit, referred to as second conductive conduit 504 (shown in FIG. 5), is used as the conductive material. Second conductive conduit 504 is wound around second leg 410 of magnetic core 402 such that each second layer 422 of second winding assembly 406 has the same orientation, referred to as a second orientation. In the embodiment illustrated in FIGS. 4 and 5, second conductive conduit 504 is helically wound around second leg 410 of magnetic core 402. In alternative embodiments, second conductive conduit 504 may be wound in any suitable layered or interleaved configuration that enables transformer 400 to function as described herein. For example, second conductive conduit 504 be wound as a disk-type winding, as described and shown in more detail above with reference to FIG. 3.

Second conductive conduit 504 is wound such that the orientation of each second layer 422 of second winding assembly 406 is substantially opposite the orientation of each first layer 420 of first winding assembly 404. Thus, second winding assembly 406 is wound around second leg 410 of magnetic core 402 in a second orientation that is substantially opposite first orientation of first winding assembly 404. In the embodiment illustrated in FIG. 4, first winding assembly 404 is the primary winding assembly, and second winding assembly 406 is the secondary winding assembly. In alternative embodiments, second winding assembly 406 may be used as the primary winding, and first winding assembly 404 may be used as the secondary winding assembly.

In the embodiment illustrated in FIGS. 4 and 5, conductive conduits 502 and 504 are insulated copper wiring, although any other suitably conductive electrical conduit that enables transformer 400 to function as described herein may be used for conductive conduits 502 and 504.

As shown in FIG. 4, first and second winding assemblies 404 and 406 are concentrically wound around second leg 410 of magnetic core 402 in an interleaved, or alternating configuration. In other words, one or more first layers 420 are interposed between one or more second layers 422 in a repeating pattern as first and second winding assemblies 404 and 406 extend radially outwards from magnetic core 402. In the embodiment shown in FIG. 4, two layers 420 of first winding assembly 404 are interposed between every two adjacent layers 422 of second winding assembly 406. In alternative embodiments, first and second winding assemblies 404 and 406 may be wound in alternative interleaved or alternating patterns. For example, first and second winding assemblies 404 and 406 may be wound such that each second layer 422 is disposed between at least two adjacent first layers 420.

Although transformer 400 is illustrated as including two winding assemblies and one winding leg, transformer 400 is not limited to the specific embodiment illustrated in FIG. 400. For example, in alternative embodiments, transformer 400 may include more than one winding leg, such as two, three, four, or even five winding legs. In further alternative embodiments, transformer 400 may include more than two winding assemblies wound in an interleaved configuration. The winding assemblies may be wound around the same winding leg, or different winding legs.

Figure 6:
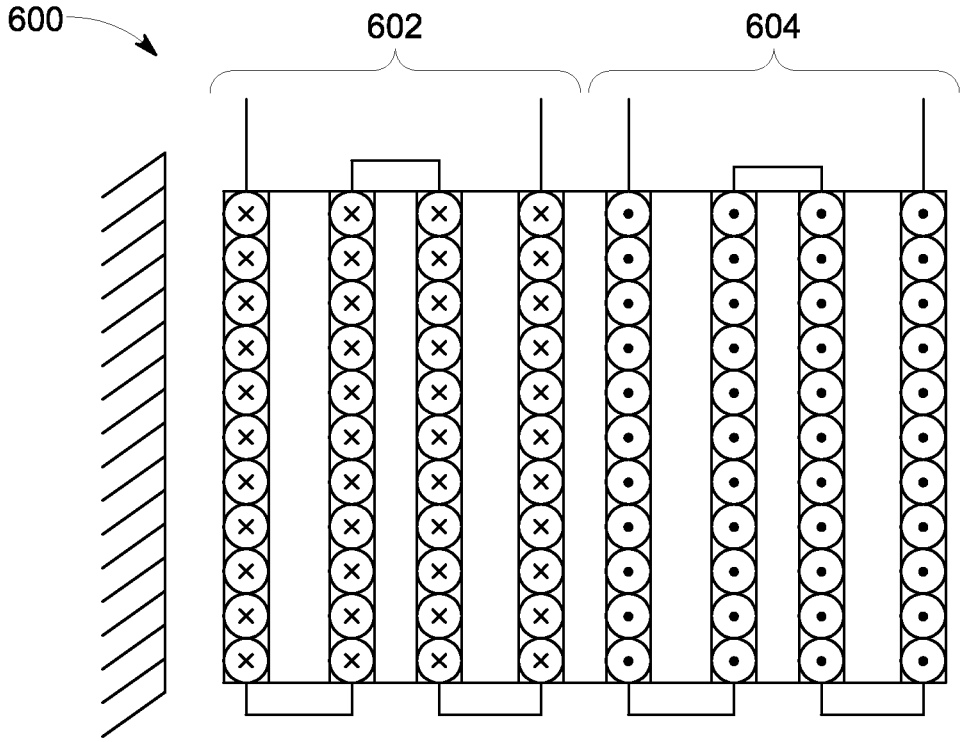
FIG. 6 is a schematic cross-sectional diagram of a conventional transformer.

FIGS. 5 and 6 are schematic cross-sectional diagrams of the transformer 400 illustrated in FIG. 4 and a conventional transformer 600, respectively. As shown in FIG. 5, each layer 420 and 422 is separated from one another by at least one insulating layer 506. Each insulating layer 506 may be a separate component within transformer 400, or insulating layer 506 may be an integral component of either the first or second layers 420 and 422. For example, each insulating layer 506 may be formed from electrical insulation surrounding each conductive conduit 502 and 504. In the embodiment shown in FIG. 5, insulating layers 506 are formed by air gaps between layers 420 and 422.

The direction of current flowing through each conductive conduit 502 and 504 in each first and second layer 420 and 422 is illustrated by an "X," indicting current flowing into the page, or an "•" indicting current flowing out of the page. As shown in FIG. 4, the current flowing through each first layer 420 flows in a substantially opposite direction to the current flowing through each second layer 422.

Referring now to FIG. 6, winding assemblies 602 and 604 of conventional transformer 600 are not arranged in an alternating or interleaved configuration. Rather, one winding assembly 602 is disposed completely within the other winding assembly 604.

Figure 7:
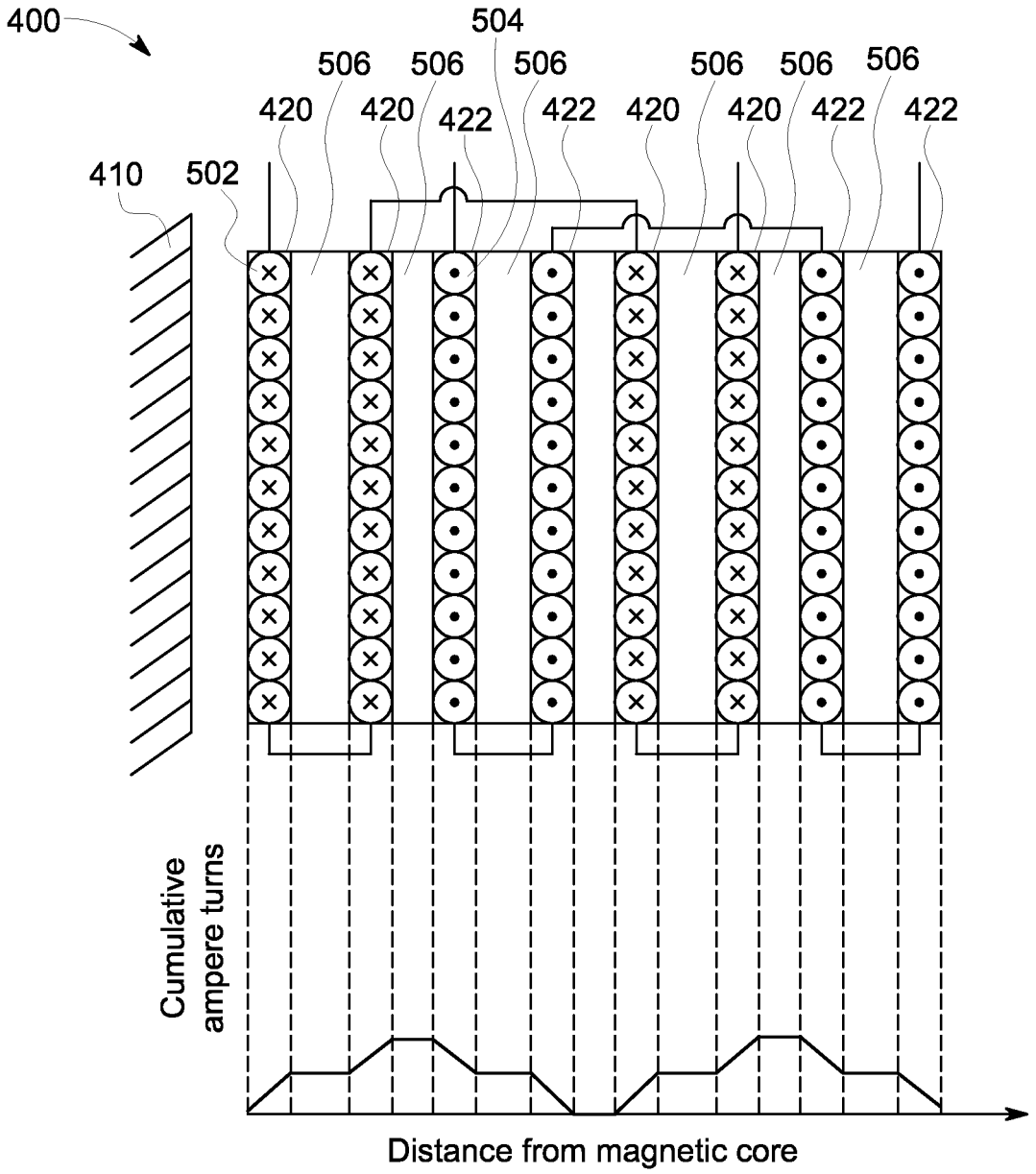
FIG. 7 is a plot of the cumulative ampere-turns within a cross-sectional area of the transformer illustrated in FIG. 5
Figure 8:
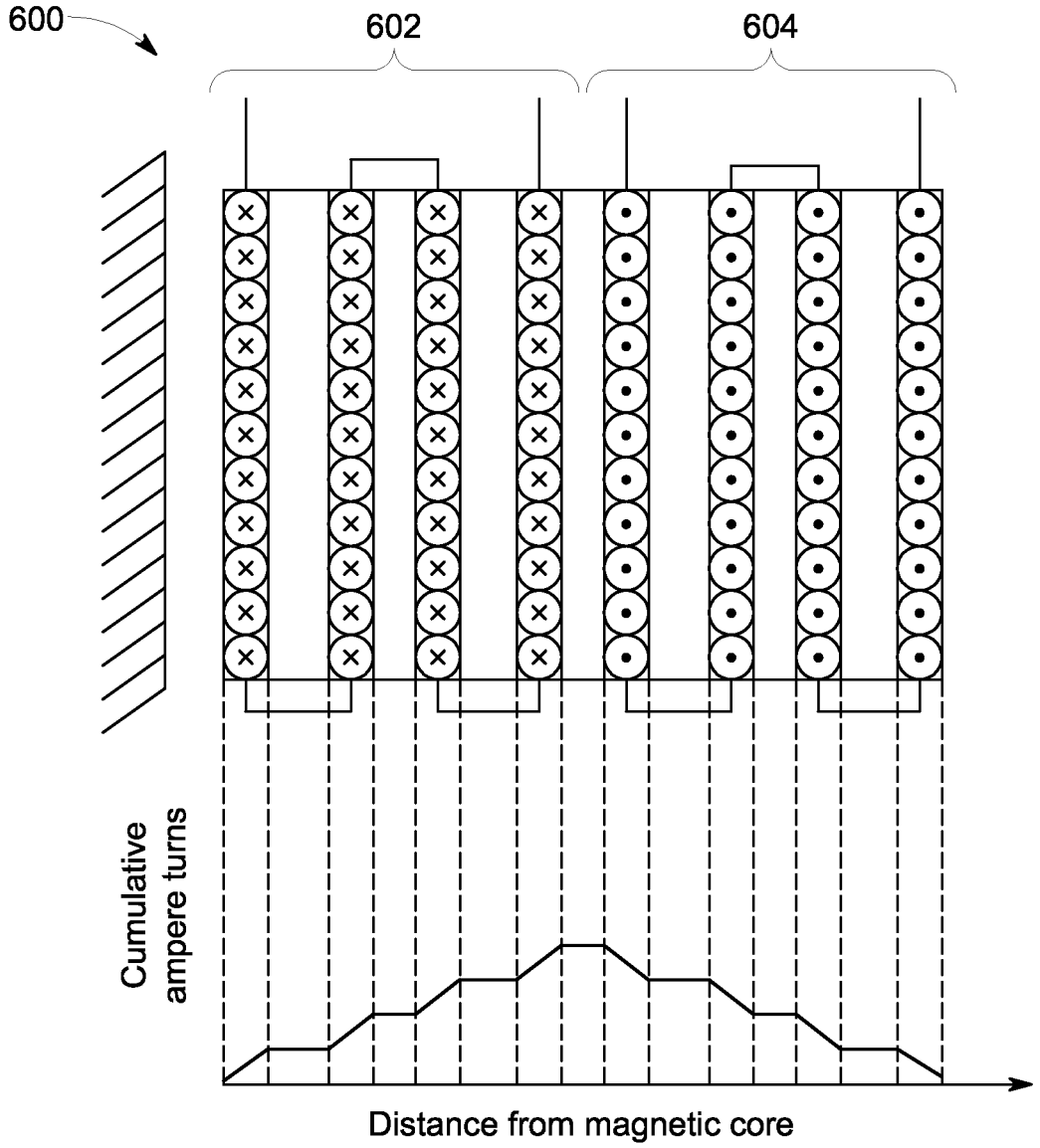
FIG. 8 is a plot of the cumulative ampere-turns within a cross-sectional area of the conventional transformer illustrated in FIG. 6

FIGS. 7 and 8 are plots of the cumulative ampere-turns within a given cross-sectional area extending in a direction perpendicular to the winding leg of transformer 400 illustrated in FIGS. 4 and 5, and conventional transformer 600 illustrated in FIG. 6, respectively. The number of cumulative ampere-turns within the windings of a transformer is directly related to the leakage flux within the windings, which accounts for a significant portion of the stray losses within a given transformer. More specifically, the leakage flux within the windings of a transformer is a function of the area under the curves shown in FIGS. 7 and 8. Thus, a larger area under the curves shown in FIGS. 7 and 8 indicates a higher leakage flux.

As shown in FIG. 8, the number of cumulative ampere-turns in conventional transformer 600 increases as each successive layer of first winding assembly 602 is taken into account. Because the current flowing through each layer of first winding assembly 602 flows in the same direction, each layer of first winding assembly 602 adds to the number of cumulative ampere-turns. The cumulative number of ampere-turns in conventional transformer 600 reaches a maximum at the outermost layer of first winding assembly 602. At this point, the opposite flowing current in layers of second winding assembly 604 begins cancelling out the ampere-turns from first winding assembly 602, thereby reducing the cumulative ampere-turns.

Referring now to FIG. 7, the alternating configuration of first and second winding assemblies 404 and 406 reduces the peak number of cumulative ampere-turns compared to conventional transformer 600. More specifically, with each iteration of the alternating pattern of first and second layers 420 and 422 of first and second winding assemblies 404 and 406, the ampere-turns of first winding assembly 404 are canceled out by the ampere-turns of second winding assembly 406 because of the current flowing in substantially opposite directions. As a result, the area under the cumulative ampere-turns curve is reduced, which indicates a decrease in the leakage flux within the windings of transformer 400 compared to conventional transformer 600. Therefore, the structure and configuration of transformer 400 improves efficiency over conventional transformers by reducing stray losses.

Figure 9:
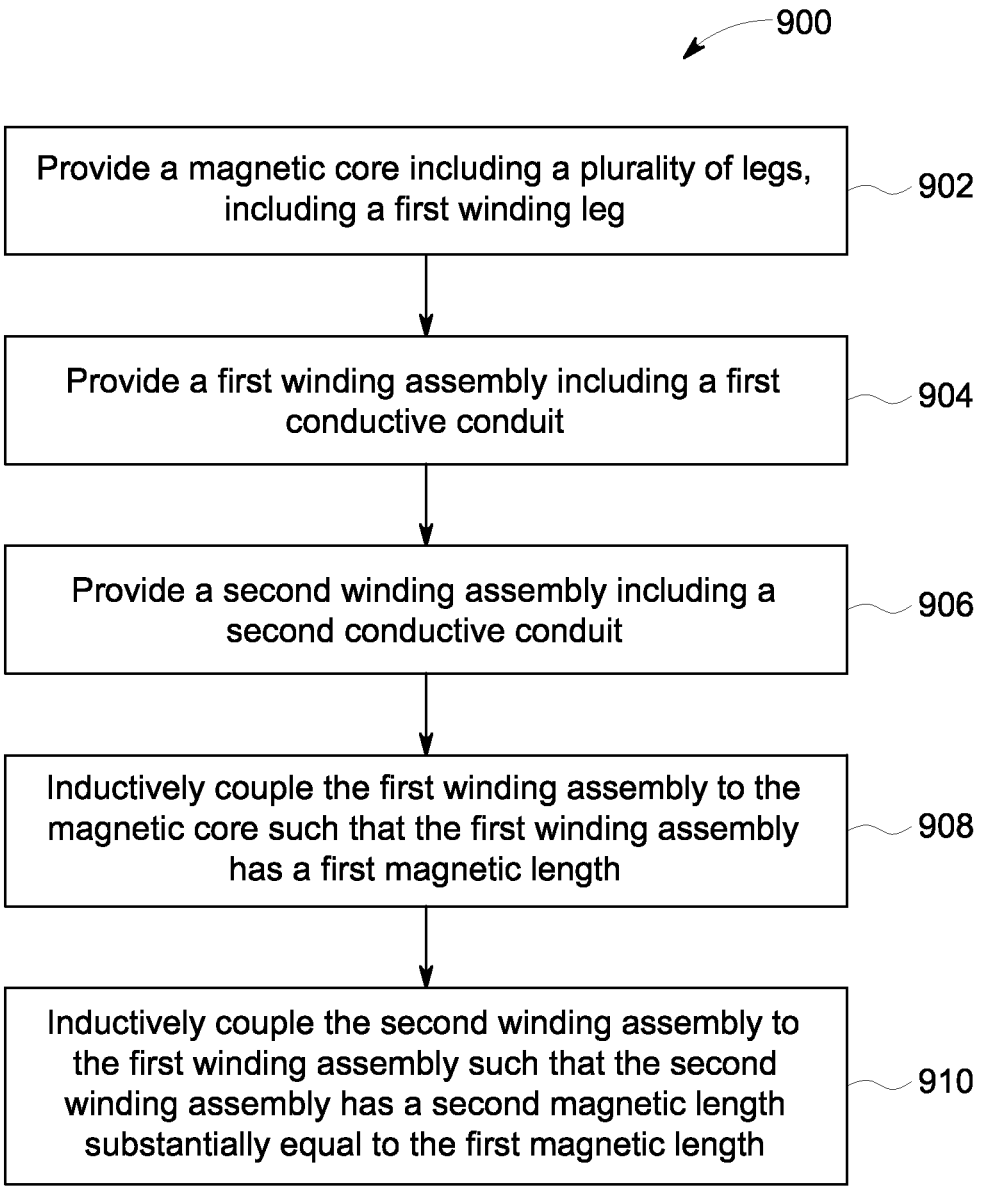
FIG. 9 is a flowchart of a method of assembling a transformer.

FIG. 9 is a flowchart of an exemplary method 900 of assembling a transformer, such as transformer 100 illustrated in FIG. 1. A magnetic core, such as magnetic core 102, is provided 902. The magnetic core includes a plurality of legs, including a first winding leg. A first winding assembly, such as first winding assembly 904, is provided 904. The first winding assembly includes a first conductive conduit. A second winding assembly, such as second winding assembly 106, is provided 906. The second winding assembly includes a second conductive conduit. The first winding assembly is inductively coupled 908 to the magnetic core by helically winding the first conductive conduit around the winding leg a first number of turns such that the first winding assembly has a first magnetic length. The second winding assembly is inductively coupled 910 to the first winding assembly by winding the second conductive conduit around one leg of the plurality of legs a second number of turns such that the second winding assembly has a second magnetic length substantially equal to the first magnetic length.

Figure 10:
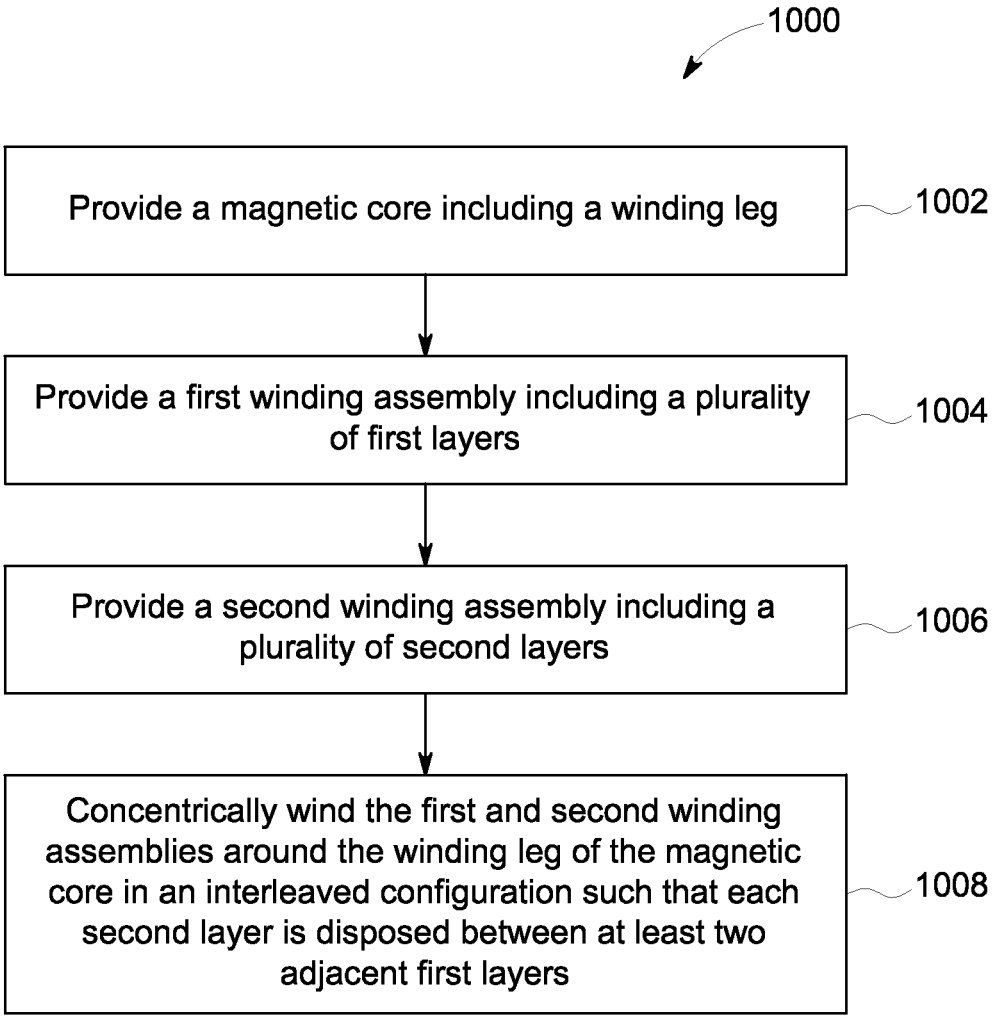
FIG. 10 is a flowchart of a method of assembling a transformer.

FIG. 10 is a flowchart of an exemplary method 1000 of assembling a transformer, such as transformer 400 illustrated in FIG. 4. A magnetic core, such as magnetic core 402, is provided 1002. The magnetic core includes a winding leg. A first winding assembly, such as first winding assembly 404, is provided 1004. The first winding assembly includes a plurality of first layers. A second winding assembly, such as second winding assembly 406, is provided 1006. The second winding assembly includes a plurality of second layers. The first and second winding assemblies are concentrically wound 1008 around the winding leg of the magnetic core in an interleaved configuration such that each second layer is disposed between at least two adjacent first layers.

Exemplary embodiments of low stray-loss transformers are described herein. In one embodiment, a transformer includes a magnetic core, a first winding assembly, and a second winding assembly. The magnetic core includes a plurality of legs, including a first winding leg. The first winding assembly has a first magnetic length, and includes a first conductive conduit helically wound around the first winding leg a first number of turns. The second winding assembly is inductively coupled to the first winding assembly, and includes a second conductive conduit wound around one of the plurality of legs a second number of turns. The second winding assembly has a second magnetic length substantially equal to the first magnetic length. In another embodiment, a transformer includes a magnetic core, a first winding assembly, and a second winding assembly. The magnetic core includes a winding leg. The first winding assembly includes a plurality of first layers, and is inductively coupled to the magnetic core. The second winding assembly is inductively coupled to the first winding assembly, and includes a plurality of second layers. The first and second winding assemblies are concentrically wound around the winding leg in an interleaved configuration. Each second layer is disposed between at least two adjacent first layers.

As compared to at least some transformers, in the systems and methods described herein, a transformer utilizes winding assemblies having substantially equal magnetic lengths. Winding assemblies having substantially equal magnetic lengths reduces stray losses associated with the partially wound sections of a magnetic core. As a result, transformers utilizing windings having substantially equal magnetic lengths have lower stray losses and improved efficiency compared to conventional transformers. Additionally, in the systems and methods described herein, a transformer utilizes concentric winding assemblies arranged in an alternating or interleaved configuration. In concentric winding assemblies arranged in an alternating or interleaved configuration, the ampere-turns of one winding assembly counteract the ampere-turns of the other winding assembly, thereby reducing the peak number of cumulative ampere-turns, and correspondingly, stray losses associated with leakage flux within transformer windings. As a result, transformers utilizing concentric winding assemblies arranged in an alternating or interleaved configuration have lower stray losses and improved efficiency compared to conventional transformers.

Additionally, utilizing winding assemblies having substantially equal magnetic lengths and/or concentrically wound winding assemblies arranged in an interleaved configuration facilitates the construction of lighter, more compact transformers. Because these designs reduce stray losses compared to conventional transformers, less heat is generated during operation. As a result, transformers may have a lighter, more compact construction because less heat needs to be dissipated during operation. This is a particularly significant advantage for transformers supplying voltages to non-linear loads, such as electronic equipment, as such transformers are often significantly oversized to prevent overheating.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A transformer comprising:

a magnetic core comprising a plurality of legs including a first winding leg;

a first winding assembly comprising a first conductive conduit helically wound around said first winding leg a first number of turns, said first winding assembly having a first magnetic length and a first axial length; and a second winding assembly inductively coupled to said first winding assembly, said second winding assembly comprising a second conductive conduit wound around one of the plurality of legs a second number of turns, said second winding assembly having a second axial length, wherein at least one of said first winding assembly and said second winding assembly covers an axial length of a respective winding leg of said magnetic core and is wound around said respective winding leg such that an axial segment of said axial length is only partially covered by said at least one first winding assembly and second winding assembly, said second winding assembly having a second magnetic length equal to said first magnetic length, wherein said first axial length is different than said second axial length, and wherein said first number of turns is different than said second number of turns.

2. A transformer in accordance with claim 1, wherein said second winding assembly is wound around said first winding leg and said first winding assembly.

3. A transformer in accordance with claim 1, wherein said second conductive conduit is helically wound around a second winding leg of said plurality of legs different than said first winding leg.

4. A transformer in accordance with claim 1, wherein said second conductive conduit is a disk-type winding assembly.

5. A method of assembling a transformer, said method comprising:

providing a magnetic core including a plurality of legs including a first winding leg;

providing a first winding assembly including a first conductive conduit;

providing a second winding assembly including a second conductive conduit;

inductively coupling the first winding assembly to the magnetic core by helically winding the first conductive conduit around the first winding leg a first number of turns such that the first winding assembly has a first magnetic length and a first axial length; and inductively coupling the second winding assembly to the first winding assembly by winding the second conductive conduit around one leg of the plurality of legs a second number of turns such that the second winding assembly has a second magnetic length equal to the first magnetic length and a second axial length different than the first axial length, wherein at least one of the first winding assembly and the second winding assembly is wound around a respective winding leg of the magnetic core such that the at least one first winding assembly and second winding assembly covers an axial length of the respective winding leg and such that an axial segment of the axial length is only partially covered by the at least one first winding assembly and second winding assembly, wherein the first number of turns is different than the second number of turns.

6. A method in accordance with claim 5, wherein inductively coupling the second winding assembly to the first winding assembly comprises helically winding the second conductive conduit around a second winding leg of the plurality of legs different than the first winding leg.

7. A method in accordance with claim 5, wherein inductively coupling the second winding assembly to the first winding assembly comprises winding the second conductive conduit around one leg of the plurality of legs such that a plurality of disks serially disposed along the axial length of the leg are formed.

* * * * *